US008177576B2

(12) United States Patent
Zhou et al.

(10) Patent No.: US 8,177,576 B2
(45) Date of Patent: May 15, 2012

(54) CONNECTOR WITH AN INNER MOLD INTEGRAL WITH A PRINTED CIRCUIT BOARD WITH PINHOLES PENETRATING A BODY OF THE CONNECTOR

(75) Inventors: Tang Zhou, Shenzhen (CN); Shaowei Geng, Guangdong (CN)

(73) Assignee: Hytera Communications Corp., Ltd., Shenzhen, Guangdong (CN)

( * ) Notice: Subject to any disclaimer, the term of this patent is extended or adjusted under 35 U.S.C. 154(b) by 0 days.

(21) Appl. No.: 12/999,451

(22) PCT Filed: Dec. 17, 2008

(86) PCT No.: PCT/CN2008/073563

§ 371 (c)(1),
(2), (4) Date: Dec. 16, 2010

(87) PCT Pub. No.: WO2010/069108

PCT Pub. Date: Jun. 24, 2010

(65) Prior Publication Data

US 2011/0086536 A1 Apr. 14, 2011

(51) Int. Cl.
*H01R 13/62* (2006.01)

(52) U.S. Cl. ..... 439/372

(58) Field of Classification Search ..... 439/372, 439/361–365, 902, 271–275
See application file for complete search history.

(56) References Cited

U.S. PATENT DOCUMENTS

| | | | | |
|---|---|---|---|---|
| 4,772,081 | A * | 9/1988 | Borgos et al. | 385/89 |
| 5,295,756 | A * | 3/1994 | Ohta | 403/11 |
| 5,453,578 | A * | 9/1995 | Ishii et al. | 174/138 R |
| 6,059,599 | A * | 5/2000 | Huang | 439/362 |
| 6,390,845 | B1 | 5/2002 | Brady | |
| 6,419,516 | B1 * | 7/2002 | Parcet | 439/364 |
| 7,270,562 | B1 | 9/2007 | Trout et al. | |
| 8,002,582 | B2 * | 8/2011 | Fakhri et al. | 439/607.44 |
| 2005/0003711 | A1 * | 1/2005 | Chang | 439/630 |
| 2007/0111584 | A1 | 5/2007 | Kuo | |

FOREIGN PATENT DOCUMENTS

| | | | |
|---|---|---|---|
| CN | 201112862 | Y | 9/2008 |
| JP | 6168744 | A | 6/1994 |

OTHER PUBLICATIONS

European Search Report and Search Opinion dated Oct. 12, 2011 from corresponding European Application No. 08878852.

* cited by examiner

*Primary Examiner* — Chandrika Prasad
(74) *Attorney, Agent, or Firm* — Wolf, Greenfield & Sacks, P.C.

(57) ABSTRACT

A connector comprises a connector body (40), a connector upper housing (10), a locking component (20) and a connecting assembly (30) provided within the connector body (40). The locking component (20) includes a locking knob (23) and a locking bolt (21). Holes are provided on the middle of the connecting assembly (30) and the connector body (40) respectively to match with the locking bolt (21). The diameter of the locking knob (23) of the locking component (20) is larger than the width of the connector body (40). The connector upper housing (10) is fixed on the connector body (40) and restricts the locking knob (23) between the connector body (40) and the connector upper housing (10).

8 Claims, 3 Drawing Sheets

CONNECTOR WITH AN INNER MOLD INTEGRAL WITH A PRINTED CIRCUIT BOARD WITH PINHOLES PENETRATING A BODY OF THE CONNECTOR

FIELD OF THE INVENTION

The present invention relates to the field of communication devices, and in particular to a connector for communication devices.

BACKGROUND OF THE INVENTION

Interconnection of communication devices and accessories or other devices relies on specific interfaces. For example, a two-way radio needs a connection interface to connect with audio accessories or a charger. In addition to transmitting audio signals and data, the interface has high requirements for reliability, ease-of-use, water resistance, dust resistance and crush resistance. Generally, a conventional connector may have one prong, as shown in FIG. 1, or may have two prongs, as shown in FIG. 2. These two types of settings are easy-to-use, but have poor reliability and signal transmission quality, and are difficult to be made waterproof. Other than the two types of settings above, a connector may be pin-based. As shown in FIG. 3, a pin-based connector includes a locking bolt 1 to secure the accessory side. The connector may provide good reliability and water resistance, but is flawed in its usability. Because, the connector is fixed to the host by the locking bolt 1, which has a small knob due to the limited space in the structure of the connector, thereby resulting in inconvenience for people to fasten and loose the locking bolt. One may need an external means, e.g., a coin, to turn the knob, in which he may get his finger cut.

SUMMARY OF THE INVENTION

A technical problem solved by the invention is to provide a reliable and easy-to-use connector, avoiding the inconvenience of conventional connecters in connecting to and detaching from a host.

A technical solution provided by the invention is to form a connector, including a connector body, a connector upper housing, a locking component, and a connecting assembly provided within the connector body, and characterized in that, the locking component includes a locking knob and a locking bolt provided on the locking knob, through-holes fitting with the locking bolt are provided on the middle of the connecting assembly and the connector body, the locking knob of the locking component has a diameter larger than a width of the connector body, and the connector upper housing is fixed on the connector body and restrains the locking knob between the connector body and the connector upper housing.

In the connector of the invention, the locking knob and the locking bolt of the locking component are formed integrally.

In the connector of the invention, an end of the locking bolt of the locking component is mounted in the locking knob, the end of the locking bolt mounted in the locking knob has a beveled edge for maintaining the locking bolt and the locking knob in synchronous rotation, and a bore fitting with the beveled edge is provided on the locking knob.

In the connector of the invention, the connecting assembly includes an inner mold, a PCB board and pins provided on the PCB board, the inner mold and the PCB board are formed integrally, and pinholes for the pins to penetrate through are provided on the connector body.

In the connector of the invention, an end of the connector body contacting with a host has a waterproofing rib, the waterproofing rib is made of an elastic material, and pinholes for the pins to penetrate through are provided on the waterproofing rib.

In the connector of the invention, a snap-fitting structure corresponding to the connector body is provided on the connector upper housing, and a mating piece fitting with the snap-fitting structure is provided on the connector body.

In the connector of the invention, an anti-slip strip is provided on the locking knob.

In the connector of the invention, a locating protuberance is provided on the connector upper housing, and a locating hole fitting with the locating protuberance is provided on the connector body.

In the connector of the invention, an end of the inner mold of the connecting assembly contacting with the locking knob has a circular boss, and a recess fitting with the boss is provided on the locking knob.

Advantageous effects of invention include that, the connector of the invention provides good usability and good water resistance, dust resistance and crush resistance; the connector of the invention is easy-to-use, and can be connected to or detached from a host without any external means; in addition, the connector of the invention has a compact structure, providing good protection against water with a rating up to IP67.

DETAILED DESCRIPTION OF THE INVENTION

Figure 1:
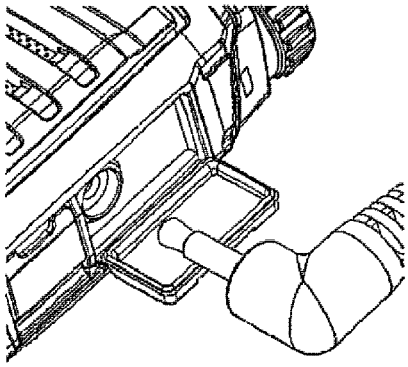
FIG. 1 (Prior Art)
FIG. 1 illustrates a one-prong connector in the prior art.
Figure 2:
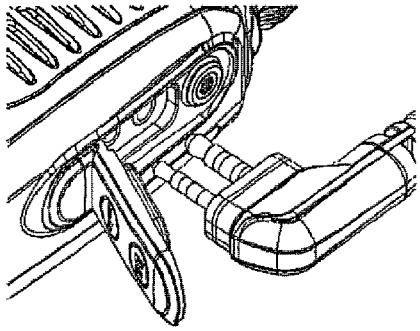
FIG. 2 (Prior Art)
FIG. 2 illustrates a two-prong connector in the prior art.
Figure 3:
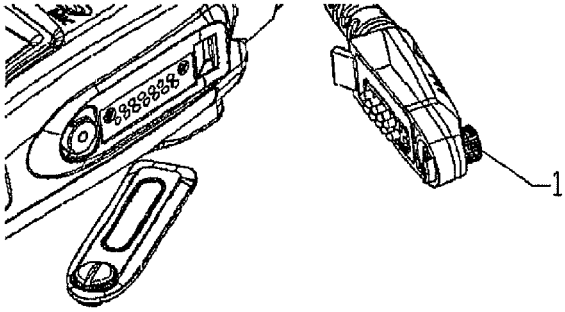
FIG. 3 (Prior Art)
FIG. 3 illustrates a pin-based connector in the prior art
Figure 4:
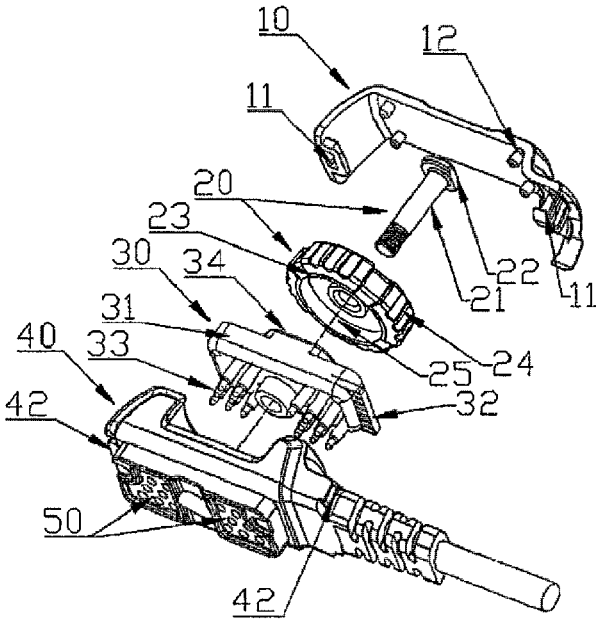
FIG. 4 is an exploded view of a preferred embodiment of a connector of the invention.
Figure 5:
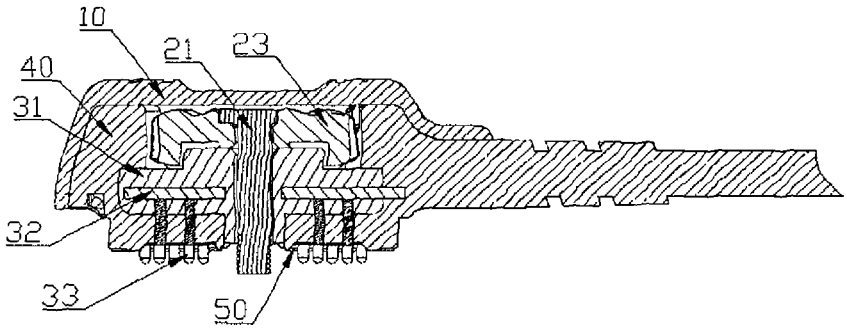
FIG. 5 is a sectional view of a preferred embodiment of the connector of the invention.
Figure 6:
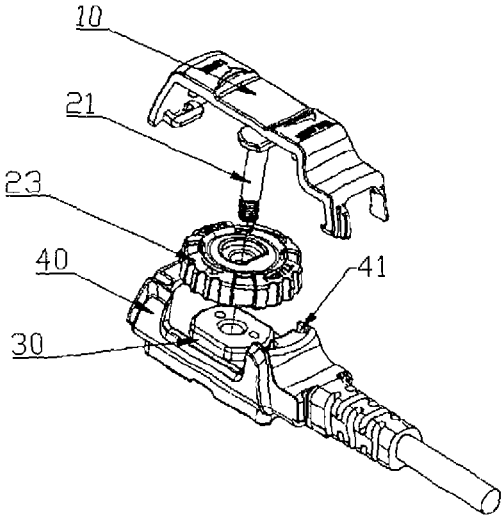
FIG. 6 is an exploded view of a preferred embodiment of the connector of the invention seen from another angle.

As shown in FIG. 4, FIG. 5 and FIG. 6, a preferred embodiment of the connector of the invention includes a connector body 40, a connector upper housing 10, a locking component 20 and a connecting assembly 30. The locking component 20 includes a locking knob 23 and a locking bolt 21 provided on the locking knob. The connecting assembly 30 includes an inner mold 31, a PCB board 32 and pins 33 provided on the PCB board 32. The inner mold 31 and the PCB board 32 are formed integrally. The connecting assembly 30 is mounted in the connector body 40. Pins 33 penetrate through pinholes provided on the connector body. Through-holes fitting with the locking bolt 21 are provided on the middle of the connecting assembly 30 and the connector body 40. The locking bolt 21 of the locking component 20 penetrates through the through-holes, and is rotatable in the through-holes. The locking knob 23 is close to the inner mold 31. The locking knob 23 of the locking component 20 has a diameter larger than a width of the connector body 40. The connector upper housing 10 is fixed on the connector body 40, and restrains the locking knob of the locking component 20 between the connector body 40 and the connector upper housing 10. The exposed part of the locking knob 23 is suited to be turned manually.

In a preferred embodiment of the connector of the invention, the locking bolt 21 is made of a metal, and the locking knob 23 is made of an engineering plastic. An end of the locking bolt 21 is mounted in the locking knob 23. To avoid relative rotation between the locking bolt 21 and the locking knob 23, the end of the locking bolt 21 mounted in the locking knob 23 has a beveled edge 22 for maintaining them in synchronous rotation. A bore fitting with the beveled edge is provided on the locking knob 23.

To improve the water resistance of the connector, an end of the connector body 40 contacting with a host has a waterproofing rib 50. The waterproofing rib 50 is made of an elastic material. Pinholes for the pins to penetrate through are provided on the waterproofing rib. The waterproofing rib 50 is attached on the connector body 40. Pins 33 penetrate through the pinholes provided on the waterproofing rib 50. While connected with the host, the waterproofing rib 50 closely fits with an external interface of the host, providing good dust resistance and water resistance.

To facilitate installing of the connector upper housing, in a preferred embodiment of the connector of the invention, a snap-fitting structure 11 is provided on the connector upper housing 10, and a mating piece 42 fitting with the snap-fitting structure 11 is provided on the connector body 40. For accurate locating, locating protuberances 12 are provided on the connector upper housing 10, and locating holes 41 fitting with the locating protuberance 12 are provided on the connector body 40.

To facilitate turning of the locking knob 23, anti-slip strips 24 are provided on the locking knob 23, to prevent slipping on the locking knob 23 and improve usability of the connector.

In a preferred embodiment of the connector of the invention, an end of the inner mold 31 of the connecting assembly 30 contacting with the locking knob has a circular boss 34, and a recess 25 fitting with the boss 34 is provided on the locking knob 23.

Figure 8:
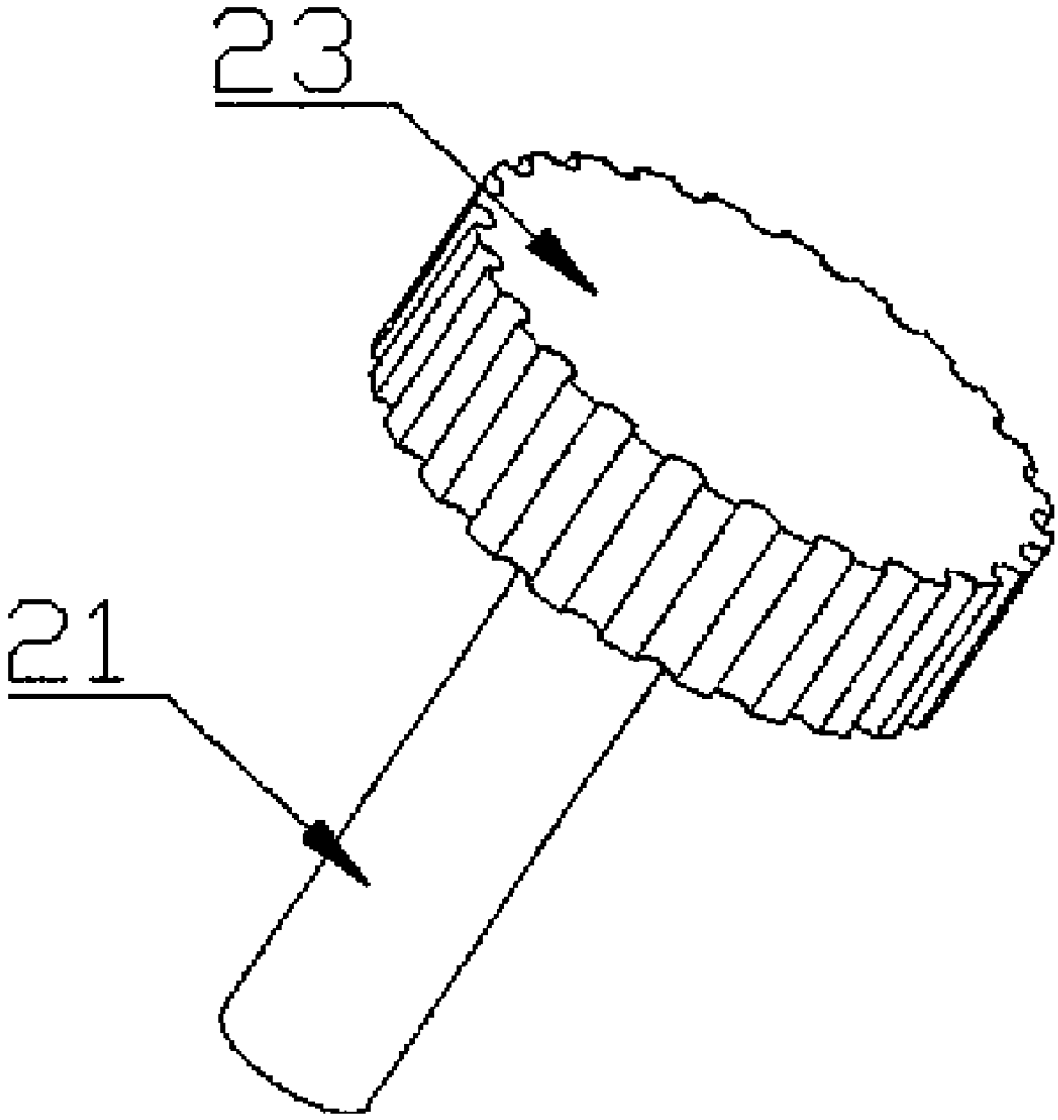
FIG. 8 illustrates a locking component of another embodiment of the connector of the invention.

In another embodiment of the invention, the locking knob 23 and the locking bolt 21 of the locking component are formed integrally, as shown in FIG. 8. They may be formed integrally with an engineering plastic or a metal. Other structures of the embodiment may be the same as those of the preferred embodiment, which are omitted here.

Figure 7:
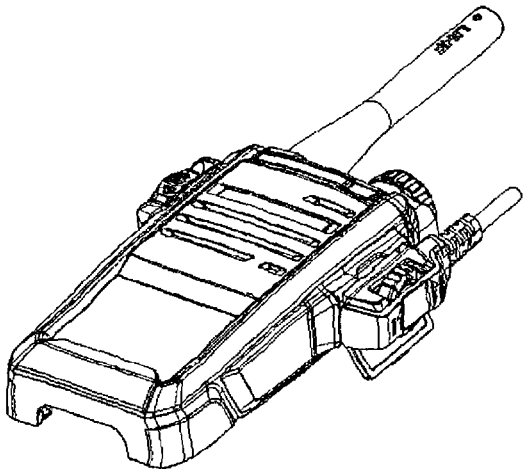
FIG. 7 is diagram showing a preferred embodiment of the connector of the invention connecting a host.

As shown in FIG. 7, while connecting the connector of the invention to the host, the locking knob 23 is turned, which drives the locking bolt 21 to rotate, into a matching locking hole of the host, thereby securing the connector to the host; and pins 33 are in contact with contacts of the host, enabling the connection between the connector and the host. Due to the waterproofing rib provided at where the connector body and the interface of the host meet, water resistance, dust resistance and crush resistance of the connector are improved. To detach the connector, it is only needed to turn the locking knob in a reverse direction. As the locking knob has a relatively large diameter and the anti-slip strips provide thereon, the connecting and detaching of the connecter and the host can be done by hands.

Preferred embodiments of the invention are described in connection with the figures. However, the invention is not limited to the embodiments discussed above, which are only exemplary and not limiting. Based on the invention, those skilled in the art may make many modifications and equivalents without departing from the principle of the invention and the scope defined by the claims. These modifications and equivalents shall be included in the scope of the invention.

The invention claimed is:

1. A connector, comprising a connector body, a connector upper housing, a locking component, and a connecting assembly provided within the connector body, wherein:

the locking component comprises a locking knob and a locking bolt provided on the locking knob, throughholes fitting with the locking bolt are provided on the middle of the connecting assembly and the connector body, the locking knob of the locking component has a diameter larger than a width of the connector body, and the connector upper housing is fixed on the connector body and restrains the locking knob between the connector body and the connector upper housing, the connecting assembly comprises an inner mold, a printed circuit board and pins provided on the printed circuit board, the inner mold and the printed circuit board are formed integrally, and pinholes for the pins to penetrate through are provided on the connector body.

2. The connector according to claim 1, wherein, the locking knob and the locking bolt of the locking component are formed integrally.

3. The connector according to claim 1, wherein, an end of the locking bolt of the locking component is mounted in the locking knob, the end of the locking bolt mounted in the locking knob has a beveled edge for maintaining the locking bolt and the locking knob in synchronous rotation, and a bore fitting with the beveled edge is provided on the locking knob.

4. The connector according to claim 1, wherein, an end of the connector body contacting with a host has a waterproofing rib, the waterproofing rib is made of an elastic material, and pinholes for the pins to penetrate through are provided on the waterproofing rib.

5. The connector according to claim 4, wherein, a snap-fitting structure corresponding to the connector body is provided on the connector upper housing, and a mating piece fitting with the snap-fitting structure is provided on the connector body.

6. The connector according to claim 5, wherein, an anti-slip strip is provided on the locking knob.

7. The connector according to claim 5, wherein, a locating protuberance is provided on the connector upper housing, and a locating hole fitting with the locating protuberance is provided on the connector body.

8. The connector according to claim 4, wherein, an end of the inner mold of the connecting assembly contacting with the locking knob has a circular boss, and a recess fitting with the boss is provided on the locking knob.

* * * * *